US009877525B2

(12) United States Patent
Strum et al.

(10) Patent No.: US 9,877,525 B2
(45) Date of Patent: Jan. 30, 2018

(54) PROTECTIVE BODY MODIFICATION APPARATUS

(71) Applicant: Velocity Systems LLC, Dulles, VA (US)

(72) Inventors: David B. Strum, Amissville, VA (US); David M. Duncan, Leesburg, VA (US)

(73) Assignee: Velocity Systems LLC, Dulles, VA (US)

( * ) Notice: Subject to any disclaimer, the term of this patent is extended or adjusted under 35 U.S.C. 154(b) by 484 days.

(21) Appl. No.: 14/666,984

(22) Filed: Mar. 24, 2015

(65) Prior Publication Data

US 2015/0272234 A1 Oct. 1, 2015

Related U.S. Application Data

(60) Provisional application No. 61/970,056, filed on Mar. 25, 2014.

(51) Int. Cl.

| | |
|---|---|
| ***A41D 13/00*** | (2006.01) |
| ***A41D 31/00*** | (2006.01) |
| ***A41D 15/00*** | (2006.01) |
| ***A41D 27/20*** | (2006.01) |
| ***A41B 9/00*** | (2006.01) |
| ***A41D 13/05*** | (2006.01) |
| ***F41H 1/02*** | (2006.01) |

(52) U.S. Cl.

CPC ..... *A41D 13/0012* (2013.01); *A41D 13/0518* (2013.01); *A41D 13/0531* (2013.01); *F41H 1/02* (2013.01)

(58) Field of Classification Search

CPC ..... A41D 13/0012; A41D 13/0518; A41D 13/0531; F41H 1/02

See application file for complete search history.

(56) References Cited

U.S. PATENT DOCUMENTS

| | | | | |
|---|---|---|---|---|
| 3,855,632 | A * | 12/1974 | Davis | F41H 1/02 2/2.5 |
| 4,578,821 | A * | 4/1986 | Zufle | F41H 1/02 2/106 |
| 5,431,318 | A * | 7/1995 | Garcia | F41C 33/00 2/2.5 |
| 6,766,529 | B1 * | 7/2004 | Nathan | F41H 1/02 2/115 |
| 6,961,958 | B1 * | 11/2005 | Seitzinger | A41D 13/0525 2/2.5 |
| 7,992,221 | B2 * | 8/2011 | Sonner | F41H 1/02 2/69 |
| 2005/0082330 | A1 * | 4/2005 | Fehlberg | A45F 3/047 224/631 |
| 2011/0131694 | A1 * | 6/2011 | Fearon | F41H 1/02 2/2.5 |

* cited by examiner

*Primary Examiner* — Anna Kinsaul
(74) *Attorney, Agent, or Firm* — Williams Mullen, PC; Thomas F. Bergert

(57) ABSTRACT

An armor-enhanced under-clothing system and/or article is provided that employs compression fabric as a figure conforming body suit element, padded elements throughout various selected parts of the body suit element for shape modification, and one or more static fabric material pockets, according to embodiments of the present invention. Anti-ballistic panels of suitable material and thickness can be inserted into the static fabric pocket element(s) designed to carry the panels.

15 Claims, 4 Drawing Sheets

PROTECTIVE BODY MODIFICATION APPARATUS

FIELD OF THE INVENTION

The present invention pertains to body modification clothing, and more particularly to armor-enhanced body modification under-clothing.

BACKGROUND AND SUMMARY OF THE INVENTION

Military and law enforcement personnel have employed armor-enhanced under-clothing in order to protect their bodies from gunfire, shrapnel, explosive devices and other harmful ballistic objects. Even when such under-clothing is sized according to individual specifications (for example, small, medium and large), the armor-enhanced under-clothing does not generally fit well, gets bunched up, prohibits smooth movement, results in undesirable gaps between body and under-clothing, has limited contact points with the body, and even hinders the withdrawal of firearms. Such disadvantages often result in poor performance and can encourage mis-use or even non-use of these protective devices.

Actors and other professionals have also employed body shape modification suits, which are used in the film industry to modify the wearer's physical form, i.e., body appearance. Examples of such uses include Eddie Murphy in "The Nutty Professor" and Robin Williams in "Mrs. Doubtfire". However, body shape modification suits are not suited to include armor enhancements. Nevertheless, there is a need for individuals conducting clandestine operations to utilize armor enhancements as well as body shape modification suits in order to maintain a properly protective physical cover.

The present invention addresses the current shortcomings and more. The present invention provides a customizable, armor-enhanced body modification device that conforms substantially to the user's body, providing better protection over critical body areas as selected by the user. In this way, the user can employ as much or as little of the system of the present invention as desired or needed for a given anticipated threat level. The present invention employs compression fabric as a base material in the top (e.g., shirt) and bottom (e.g., shorts) system elements, padded elements throughout various selected parts of the base material (e.g., for body form/shape modification), and further can include one or more static fabric material harnesses. The material can be provided in different forms depending upon desired characteristics (e.g., wicking, fire resistance, temperature management, anti-microbial, etc.). Anti-ballistic panels of suitable material and thickness can be inserted into the static fabric material harness or pocket designed to carry the panels while preventing any undesirable bouncing effect. In one embodiment of the present invention, the top and bottom elements are adapted to be secured to one another using hook-and-loop fasteners or similar fasteners to facilitate comfort, intended purpose and overall fit. In another embodiment of the present invention, the top and bottom sections are integrated as a single piece or article of under-clothing. The present invention can be provided in sleeveless, short sleeve and long sleeve shirts, shorts and pants, for example.

DETAILED DESCRIPTION OF EMBODIMENTS OF THE PRESENT INVENTION

Figure 1:
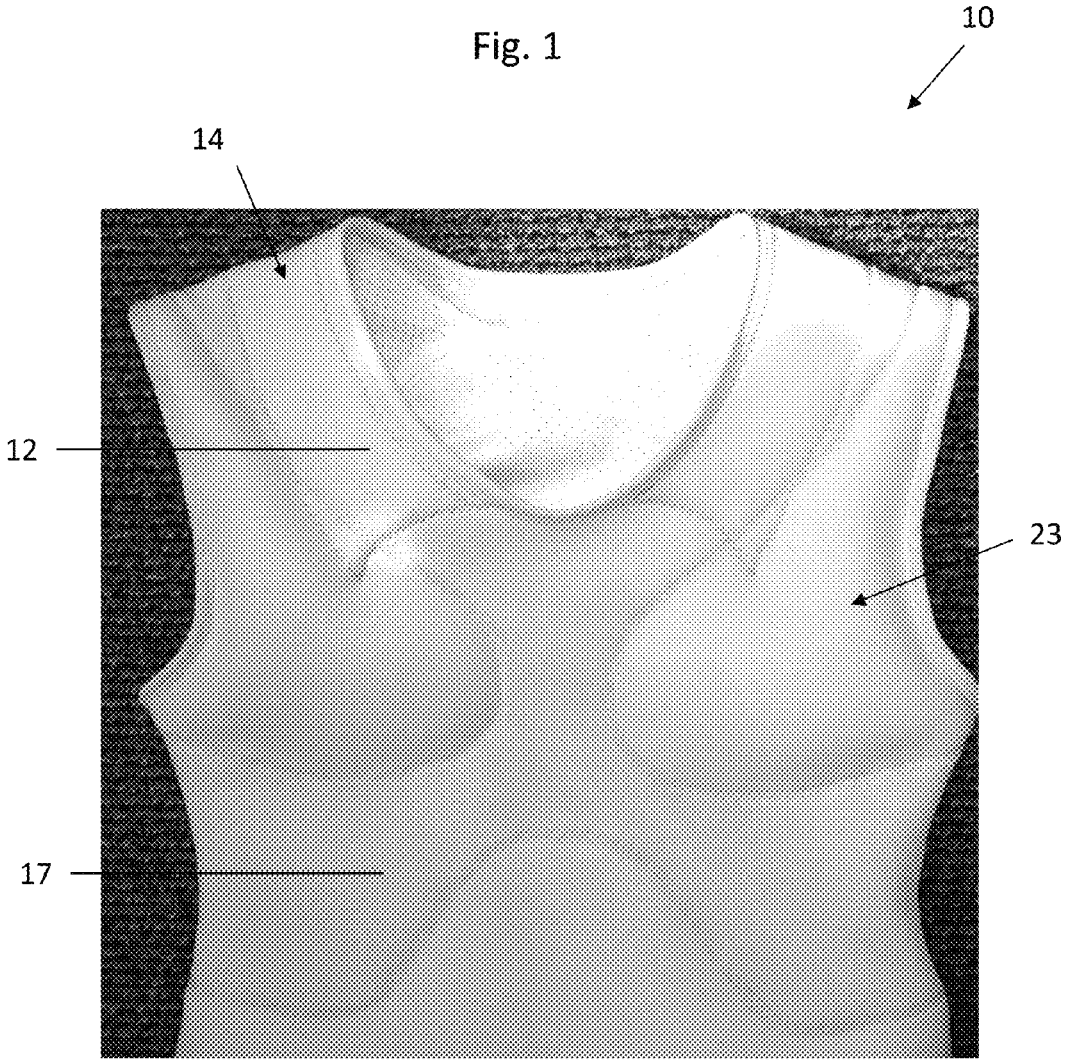
FIG. 1 shows a front view of one embodiment of an outer portion of a top element as provided by the system of the present invention.
Figure 2:
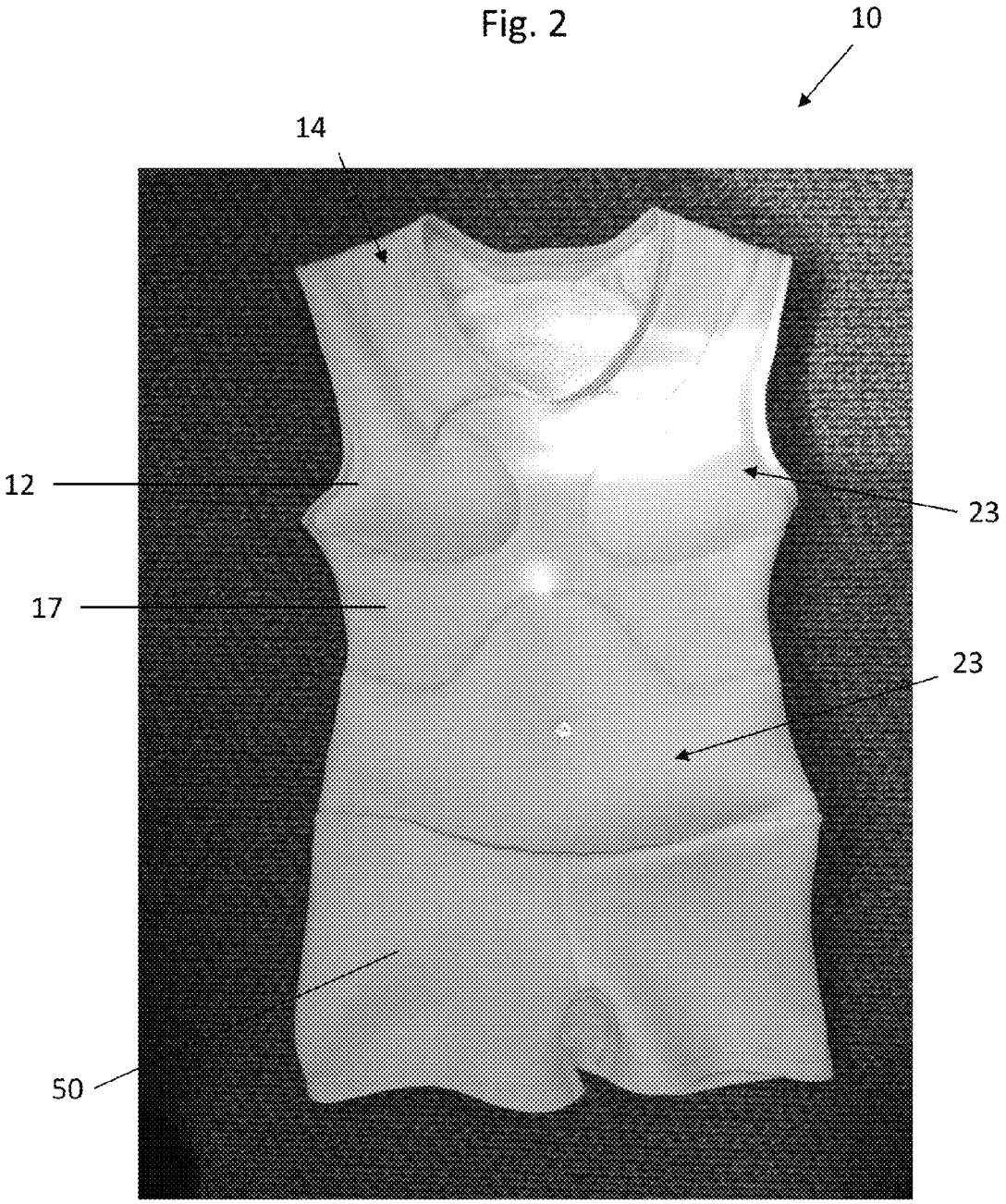
FIG. 2 shows a front view of one embodiment of an outer portion of an integrated top and bottom element as provided by the system of the present invention.
Figure 3:
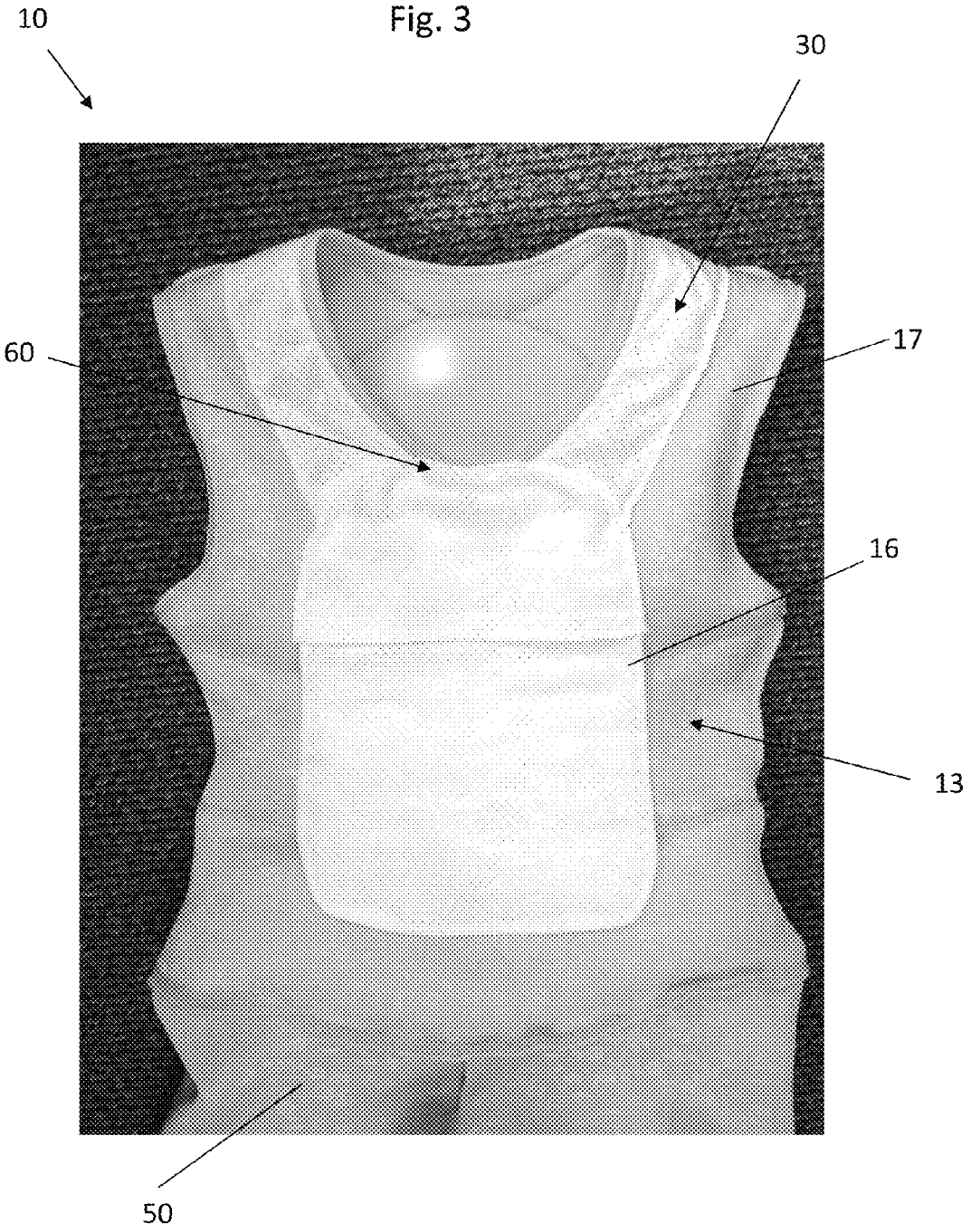
FIG. 3 shows a front view of one embodiment of the element of FIG. 2 as inverted to show the inner portion of a front side thereof.

As shown in FIGS. 1 through 3, the front side 14 of one embodiment of a top element 12 of the article 10 of the present invention includes a suitably-sized interior pocket 16 within a base material or body suit element 17 for receiving a suitably-sized front torso ballistic panel (not shown). In various embodiments of the present invention, the body suit element 17 comprises a compression fabric designed to snugly fit the wearer with 100% body contact. As such, the body suit element 17 can be composed of a material with high tenacity stretch which provides muscles with a firm compression fit that lessons vibrations, reduces fatigue, and keeps muscles energized. The fabric can be formed in a knit construction, for example, using a series of gradient fibers with an open knit inner surface to create a moisture transfer environment. In embodiments of the present invention, the top 12 and/or bottom 50 elements of body suit element 17 can include padded elements 23 throughout various selected parts of the base material (e.g., for body shape modification). The padded elements 23 can be formed of a pliable cushion bead or fill, made of natural or synthetic material, for example, and can be sewn in to the top 12 and/or bottom 50 elements of the article of the present invention. Thus, the body suit element 17 substantially fits the actual body form of the wearer, while the padded elements 23 alter the body form appearance of the wearer. For instance, a wearer may have an athletic or muscular, trim build and placing the body suit element 17 on the wearer would result in an appearance that reflects the same athletic or muscular, trim build. However, when the padded elements 23 are included with the body suit element 17, the wearer with the athletic or muscular, trim build can have an appearance that is changed, such as to reflect a much heavier person, for example. As embodiments of the article of the present invention are provided as under-clothing, it will be appreciated that additional clothing worn over the article of the present invention can further assist an individual in clandestine operations.

In various embodiments, the body suit element 17 is comprised of compression fabric material, with a front interior surface 13, a front exterior surface 81, a back interior surface 73, a back exterior surface 82, a neck portion 84 forming a head opening 85, first 86 and second 87 shoulder portions forming first 88 and second 89 arm openings, respectively, and first 61 and second 62 leg portions forming first 63 and second 64 leg openings, respectively, wherein the body suit element 17 substantially fits the form of a wearer as described above.

In various embodiments, the pocket or pockets (e.g., 16, 26) generally include an opening through with panels can be inserted and removed. This facilitates customization of the anti-ballistic properties of the present invention, as heavier and thicker panels may be needed for some engagements, while lighter and thinner panels may be needed for other engagements. In various embodiments of the present invention, the pocket or pockets 16 are constructed with panels retained therein, and then sealed so that the panels remain permanently part of the top element. The pockets can comprise a variety of materials, including compression fabric, or alternatively a static fabric material retaining greater strength and resisting movement more than compression fabric.

Figure 4:
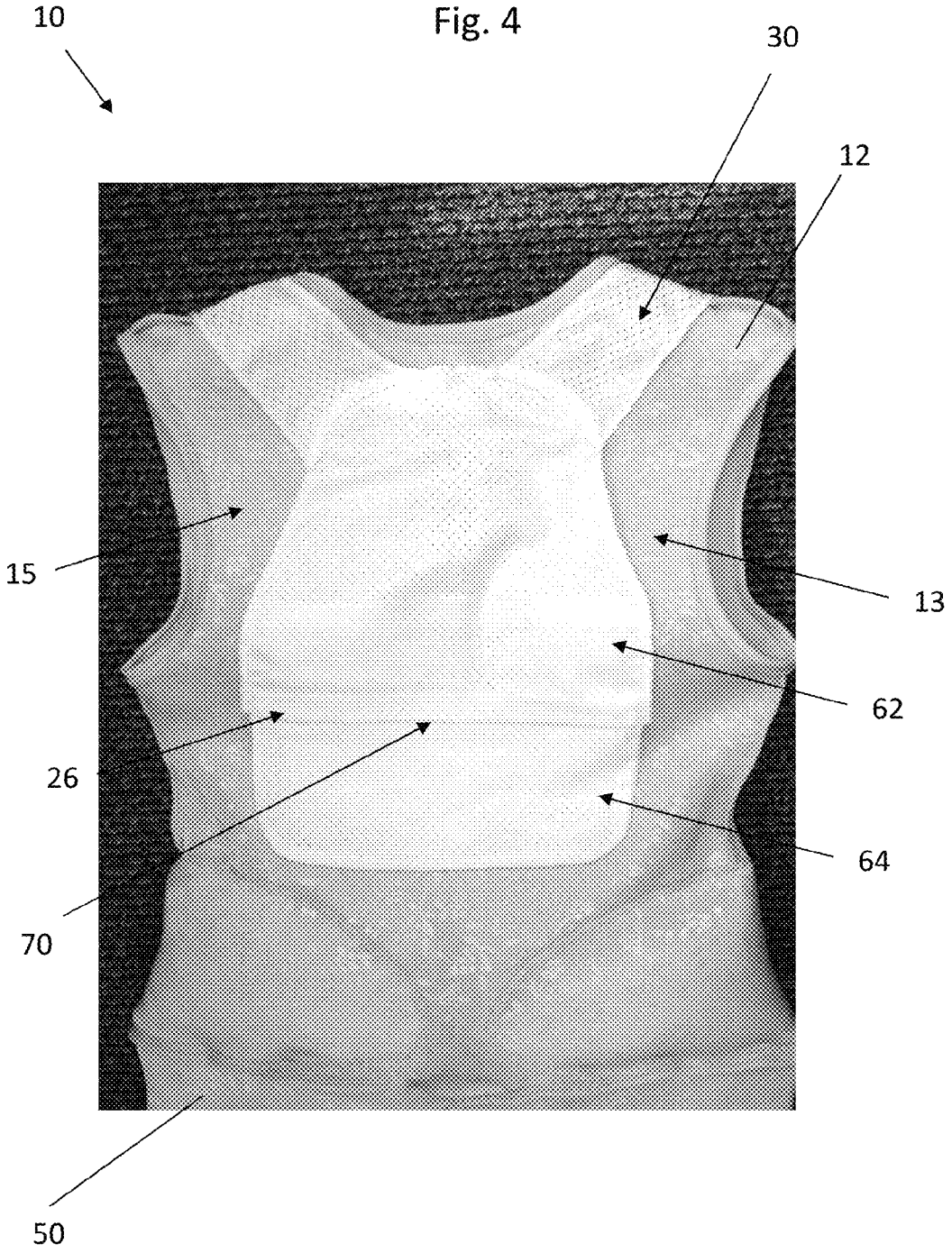
FIG. 4 shows a front view of one embodiment of the element of FIG. 2 as inverted to show the inner portion of a back side thereof

As shown in FIG. 4, the back side 15 of the top element 12 includes a suitably-sized interior pocket 26 for receiving a suitably-sized back torso ballistic panel (not shown). As FIGS. 3 and 4 show the front interior 13 and back interior 73 surfaces of the top element 12, it will be appreciated that the pockets 16, 26 are on the interior and are not generally accessible from the front exterior 81 or back exterior 82 surfaces of the top element 12, which assists in the concealability and comfort of the present invention.

As shown in the embodiment of the present invention in FIGS. 3 and 4, the top element 12 can include epaulets 30 over the shoulder area, wherein the epaulets 30 can be provided as a two-ply material with an interior surface that forms a channel through which strap or clip members (not shown) can extend, in various embodiments of the present invention. The strap and clip members can be used to retain additional panels within or over the surface of the body suit element 17. In other embodiments of the present invention, the epaulets comprise a two-ply material but not internal straps or clip members are employed. In still other embodiments of the present invention, the epaulets 30 are a single play material with no channel, and the epaulets 30 act to provide structural assistance in securing the interior pockets 16, 26 on the front 14 and back 15 sides of the top element 12. In embodiments of the present invention, the epaulets 30 comprise, for example, a non-compression, static material secured to and extending from the front interior surface to the back interior surface of the top element.

In embodiments of the present invention, the material of bottom element 50 comprises a similar material and/or the same material as the compression fabric described above with regard to top element 12 of the body suit element 17.

In operation, a wearer of the present invention may select one of various previously constructed body modification suits to fit a particular purpose, including, for example, portraying a heavier person, a physically fit person or any of various other desired human shapes. The wearer can further select a shape with previously installed ballistic panels that have been selected and sewn in, or where ballistic panels are already inserted into pockets in the top and/or bottom elements of the present invention. Selections can be made according to the wearer's size (e.g., small, medium and large) and/or intended purpose. Alternatively, the wearer may select the top and bottom elements without any ballistic panels installed, put on the top and bottom elements, and then install appropriate ballistic elements in the available pockets as desired for an anticipated engagement. It will be appreciated that the pockets can be openable and sealable using hook and loop type fasteners, or other appropriate fasteners to enable quick assembly and dis-assembly. Accordingly, one aspect of the present invention provides a protective clothing system and/or article of underclothing with a standardized set of pockets which may or may not be fully employed for a given engagement, but which do not reduce the ergonomic design and comfortable fit, regardless of whether the pockets are filled with suitable ballistic material.

The ballistic material can comprise, for example, layers of fibers that may comprise a high molecular weight polyethylene material, an aramid fiber, a combination of high performance fibers, or a non-woven thermoplastic composite. Commercially available embodiments of the ballistic material are known as Dyneema™ and Spectrashield™, for example.

The present invention allows for ballistic or fabric inserts (e.g., as assessed by potential threat) to be sewn into or placed in a pocket or sleeve, for example. The inserts and article of various embodiments of the present invention can also protect the end user from sand, ballistic fragments, etc., as a secondary layer. In one embodiment of the present invention, the tops or bottoms in any configuration will cover areas that traditional body armor does not. As such, an end user can wear the tops or bottoms of the present invention under their traditional body armor and the tops and bottoms would have extra protection in the areas that the body armor does not cover. Optionally, there may be additional protection for the lower abdominal area, arms, under arms, upper legs, etc.

As such, the present invention can conceal the armor, keep the armor or protection in the correct place, allow it to fit a great range of people, allow for multiple overlap points for extreme comfort, provide interchangeable armor components in order to adjust for size, and allow the tops and bottoms in one size to adjust within the pocket or sleeve so that the same component can permit different thickness inserts to be employed.

With regard to pockets, the chest pocket 16 shown in FIG. 3 can be secured at least in part to the epaulets 30 and further secured to the front interior surface 13 of the top element 12, such as through sewing one or more seams. In one embodiment of the present invention, the chest pocket 16 is secured to the front interior surface 13 along the upper perimeter boundary of the chest pocket 16, which is shown along seam 60 in FIG. 3 as a substantially inverted U-shaped seam. Further, the chest pocket 16 can comprise a two-ply static fabric element that provides a durable and strong material for the purposes of securely retaining ballistic-resistant material as described hereinafter. In one embodiment of the present invention, the epaulets 30 comprise a static material that does not stretch. Such a material can be considered a "jersey mesh" material in accordance with one embodiment of the invention. By not stretching, any armor inserted into the pockets (e.g., 16, 26) described herein will not be permitted to bounce around. The bouncing of armor inserts is undesirable because it can reduce effectiveness, comfort and desire for the user to employ armor. The first or back ply of the chest pocket 16 can be retained against the inner surface 13 of the top element 12 via seam, while the second or front ply of the chest pocket 16 can otherwise hang freely over a first pocket bag portion, i.e., the opening in the pocket 16.

The opening, which can be found underneath edge area 69 in the pocket 16 shown in FIG. 3, can accommodate the insertion or removal of ballistic inserts. It will be appreciated that the pocket bag 16 can be a separable component that is not integrated with the top element 12, but is rather connectable and disconnectable using a zipper-type connection, hook-and-loop type connection or other type of temporary connection.

As further shown in FIG. 4, the pocket 26 on the back side 15 of top element 12 can be secured to the epaulets 30 and further secured to the interior surface 13 of the back side 15 of top element 12. In one embodiment of the present invention, the pocket 26 is secured to the epaulets 30 and the interior surface 13 of the top element 12, and the epaulets 30 are secured to the interior surface 13 of the top element 12, such as by sewing a seam, for example. In one embodiment of the present invention, the back side 15 and the pocket 26 each comprise separate two-ply constructions. In one embodiment of the present invention, the back ply portion of the second pocket bag 26 is integrally formed with the back ply of the back 15 of top element 12, but the second pocket bag 26 is generally not secured to the top element 12 and hangs freely from the back 15. In another embodiment of the present invention, the back ply portion of the second pocket bag 26 is securely retained to the interior surface 13 through sewing a seam. In various embodiments, a top seam 90, side seams 91 and bottom seam 92 can be employed, as shown in FIG. 4. The front ply portion of the second pocket bag 26 can similarly hang freely while being secured along the outer perimeter to the back ply portion. In embodiments of the present invention, the pocket 26 has a top portion 62 and a bottom portion 64, with the top portion 62 being longer then the bottom portion 64, and with each of the top 62 and bottom 64 portions having the front ply secured to the back ply along multiple edges, but not being secured along adjacent edges as indicated at 70. In this way, a wearer or a person assisting a wearer, can open the pocket at the adjacent edge area 70 to insert a ballistic panel into the top 62 and bottom 64 portions.

It will be appreciated that the pocket 26 can be a separable component that is not integrated with the interior portion 13 of the back 15 of the top element 12, but is rather connectable and disconnectable using a zipper-type connection, hook-and-loop type connection or other type of temporary connection.

In various embodiments of the present invention, only a portion of the outer perimeter of the pocket 16 and/or 26 is secured to the interior surface 13 or 73, respectively, of the body suit element. For example, with pocket 26, the top seam 90 and side seams 91 can be provided, but at least the bottom edge 98 of the pocket 26 is not secured to the body suit element 17 (i.e., no seam 92 as in FIG. 4). In other embodiments, the top seam 90 is provided but side 91 and bottom 92 seams are not provided. Similarly, for pocket 16 in FIG. 3, the top seam 60 can be provided, but either no seam is provided along the side 67 and bottom 68 of the perimeter of the pocket 16, or seams are only provided on a subset thereof. In this way, the pockets 16 and/or 26 can hang somewhat freely, which may be desirable in certain deployments of embodiments of the present invention.

In various embodiments of the present invention, one or more cushions 23 are employed and secured at different independent and non-overlapping locations 101, 102 and 103 of the body suit element 17, as shown in FIG. 2. In various embodiments, the cushion locations can be overlapping. Further, as shown in FIG. 3, in various embodiments, the pocket element 16 can lie underneath part or all of one or more of the cushion locations 101, 102, 103. It will be appreciated that FIG. 3 shows the interior 13 of body suit element 17, such that cushion location 102 is on the right side, whereas FIG. 2 shows the exterior of body suit element 17, such that cushion 102 is on the left side. Additionally, when one or more ballistic panels are inserted into the pocket 16, the panel lies underneath at least a portion of one or more of the cushion locations.

It will be appreciated that the protective clothing system and/or article of the present invention thus provides a customizable armor-enhanced clothing system and/or article that conforms more substantially to the user's body, with a body modification enhancement to alter the appearance of a user's body, and with better protection over selectable body areas. The present invention further provides such an article whereby the top element comprises an outer compression fabric layer with an inner non-compression fabric pocket and/or harness element.

The present disclosure describes numerous embodiments of the present invention, and these embodiments are presented for illustrative purposes only. These embodiments are described in sufficient detail to enable those skilled in the art to practice the invention, and it will be appreciated that other embodiments may be employed and that structural, and other changes may be made without departing from the scope or spirit of the present invention. Accordingly, those skilled in the art will recognize that the present invention may be practiced with various modifications and alterations. Although particular features of the present invention can be described with reference to one or more particular embodiments or figures that form a part of the present disclosure, and in which are shown, by way of illustration, specific embodiments of the invention, it will be appreciated that such features are not limited to usage in the one or more particular embodiments or figures with reference to which they are described. The present disclosure is thus neither a literal description of all embodiments of the invention nor a listing of features of the invention that must be present in all embodiments.

The invention claimed is:

1. An article of under-clothing, comprising:

a body suit element comprising a fabric material having elasticity, with the body suit element having a front interior surface, a front exterior surface, a back interior surface, a back exterior surface, a neck portion forming a head opening, first and second shoulder portions forming first and second arm openings, respectively, and first and second leg portions forming first and second leg openings, respectively, wherein the body suit element substantially fits the body form of a wearer;

at least one pliable cushion secured to the front or back exterior surface of the body suit element, wherein the cushion alters the body form appearance of a wearer;

a pocket element secured to and extending from the front interior surface or the back interior surface of the body suit element;

at least one epaulet secured to and extending from the front interior surface to the back interior surface of the body suit element, wherein the epaulet has an interior surface forming a channel; and a strap extending through the channel in the epaulet.

2. The article of claim 1 wherein the pocket element includes a chest portion secured to the at least one epaulet and further secured to the front interior surface of the body suit element.

3. The article of claim 2 wherein the pocket element has side edges and a bottom edge, and wherein at least the bottom edge of the pocket element is not secured to the body suit element.

4. The article of claim 1 wherein the pocket element includes an upper back portion secured to the back interior surface of the body suit element.

5. The article of claim 1, further including a ballistic insert maintained within the pocket element.

6. The article of claim 5, wherein the pocket element comprises a two-ply material secured to the front interior surface so as to form an opening between the two plies, and wherein the ballistic insert is further maintained within the opening between the two plies.

7. The article of claim 1 wherein the body suit element is a single integrated article.

8. The article of claim 1, wherein the pocket element is secured to the at least one epaulet.

9. The article of claim 1 wherein the pocket element comprises a material that is not elastic.

10. An article of under-clothing, comprising:

a body suit element comprising a fabric material having elasticity, with the body suit element having a front interior surface, a front exterior surface, a back interior surface, a back exterior surface, a neck portion forming a head opening, and first and second shoulder portions forming first and second arm openings, respectively, wherein the body suit element substantially fits the body form of a wearer;

at least one pliable cushion secured to the front or back exterior surface of the body suit element, wherein the cushion alters the body form appearance of a wearer;

a pocket element secured to and extending from the front interior surface or the back interior surface of the body suit element;

at least one epaulet secured to and extending from the front interior surface to the back interior surface of the body suit element, wherein the epaulet has an interior surface forming a channel; and a strap extending through the channel in the epaulet.

11. The article of claim 10, wherein the pocket element lies underneath the at least one cushion.

12. The article of claim 10, wherein the at least one pliable cushion comprises two or more independent cushions secured to independent locations on the front exterior surface of the body suit element.

13. The article of claim 12, wherein the pocket element lies underneath at least a portion of the independent locations of the independent cushions on the body suit element.

14. The article of claim 10, further including a ballistic panel inserted into the pocket element.

15. The article of claim 14, wherein the at least one cushion is secured to a first location on the front exterior surface of the body suit element, and further wherein the ballistic panel lies underneath at least a portion of the location of the at least one cushion.

* * * * *